United States Patent [19]

Coin

[11] Patent Number: 4,604,760

[45] Date of Patent: Aug. 12, 1986

[54] BRIDAL HEADDRESS APPARATUS

[76] Inventor: Sheri K. Coin, 519 Ave. E, Apt. B, Billings, Mont. 59102

[21] Appl. No.: 703,393

[22] Filed: Feb. 20, 1985

[51] Int. Cl.[4] ..... A42B 1/16

[52] U.S. Cl. ..... 2/209.2; 2/185 R; 2/207; 362/104

[58] Field of Search ..... 2/209.2, 207, 185 R, 2/198, 199, 171; 362/103, 104, 105, 106

[56] References Cited

U.S. PATENT DOCUMENTS

| | | | |
|---|---|---|---|
| 1,671,889 | 5/1928 | Dorros | 2/207 |
| 2,640,980 | 6/1953 | Prupis | 2/185 R |
| 3,450,872 | 6/1969 | Aiello | 362/104 |
| 3,501,628 | 3/1970 | Madden | 362/104 |
| 3,872,517 | 3/1975 | Miller | 2/207 |
| 4,488,316 | 12/1984 | Mosca | 2/209.2 X |

*Primary Examiner*—Henry S. Jaudon
*Assistant Examiner*—Judy Olds
*Attorney, Agent, or Firm*—Arthur L. Urban

[57] ABSTRACT

Bridal headdress apparatus includes a frame portion, a fastening portion, a supporting portion, an illuminating portion, a diffusing portion, a power supplying portion and a circuitry portion. The frame portion includes a face section formed with spaced generally parallel horizontal elongated upper and lower peripheral sections with end sections extending between the horizontal sections. The fastening portion includes at least one securing member extending from the lower horizontal section. The supporting portion includes an intermediate section extending between the horizontal upper and lower sections. The illuminating portion includes a plurality of spaced miniature incandescent lamps disposed along the length of the supporting portion. The diffusing portion includes a semi-transparent membrane over the lamps with the membrane being disposed on the side of the lamps adjacent the face section of the frame portion. The power supplying portion includes a plurality of thin elongated batteries mounted remote from the lamps. The circuitry portion includes conductors connecting the spaced lamps in parallel electrically with the batteries and a switch controlling the flow of electrical current from the batteries to the lamps.

20 Claims, 5 Drawing Figures

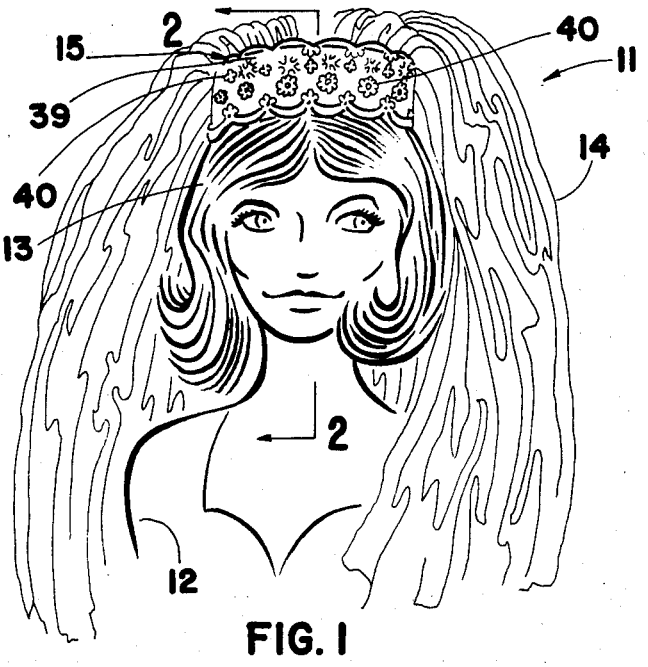
FIG. 1
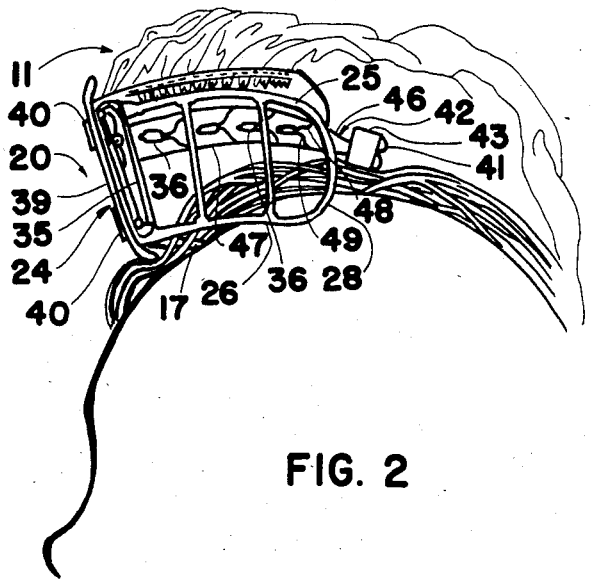
FIG. 2
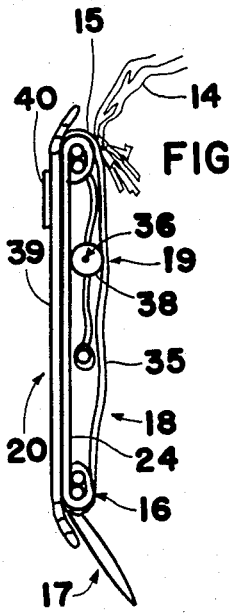
FIG. 3
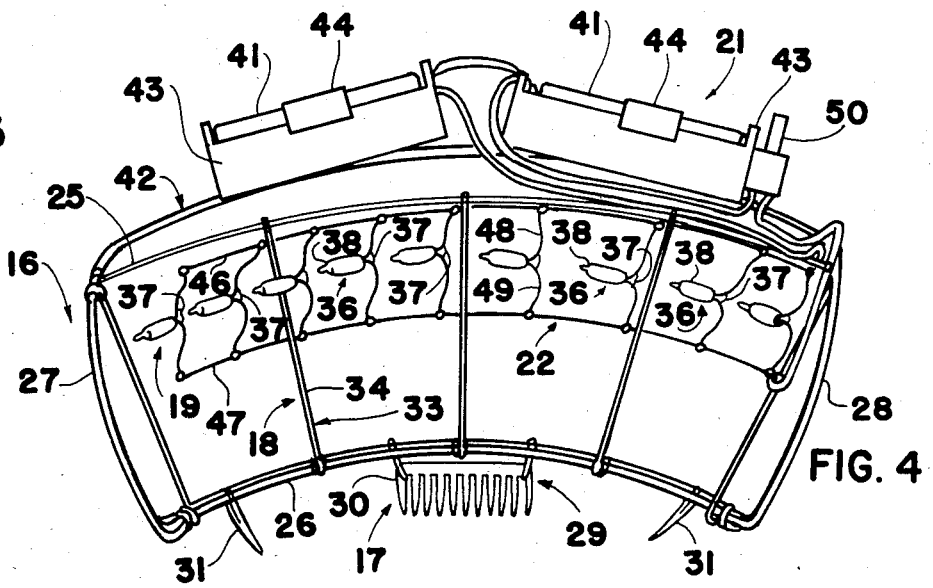
FIG. 4
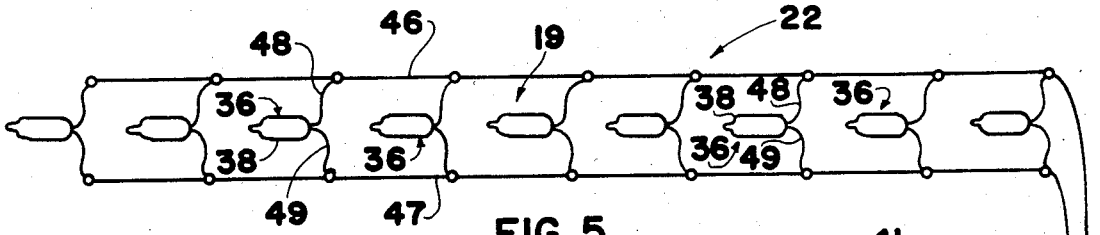
FIG. 5
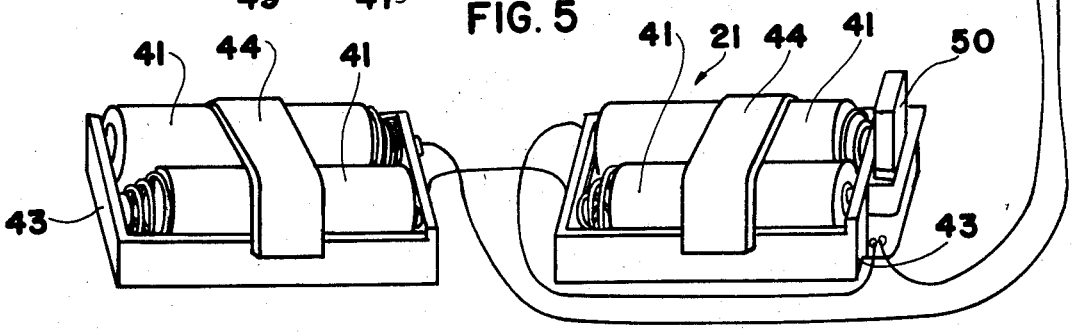

BRIDAL HEADDRESS APPARATUS

This invention relates to a novel headdress apparatus and more particularly relates to a new bridal headdress apparatus.

Throughout history, brides have worn a wide variety of costumes at their weddings. Some brides have worn simple decorations of flowers, foliage and the like as a head decoration. As weddings became more formal, brides sought headpieces that would blend with the other costume features particularly the gown. Tiaras, hats and the like were adopted either alone or in combination with veils.

Since the widespread acceptance of veils, there have been few new ideas in formal bridal headdresses. As a result, some brides are looking back to styles of earlier times. Although such period designs may still be beautiful and appealing, they may not coordinate well with modern hairstyles and makeup.

In an attempt to achieve a bridal headdress that coordinates better with current hair and makeup styles, many brides are turning to very casual designs such as wreaths, bands, hats and the like. However, even these variations are not unique and may not provide the desired accent for a bride's gown and other accessories.

Another factor that may influence a bride's selection of a headdress is the fact that most people who attend the wedding generally are at a distance that does not permit discernment of fine details of the outfit. Many brides select clothing for their wedding that has a great deal of fine detail since they make their selection at very close range. However, at the wedding and the reception, guests are within close range of the bride for only a few moments as they converse with the bridal party and the remainder of the time are at a considerable distance. Therefore, guests can only observe details of the bridal attire when they are quite large in size.

From the above discussion, it is clear that presently available bridal headdresses do not provide desired solutions for many of today's brides. A bride either has to choose a design that is similar to headpieces of many other brides or she selects a design that is unique but may not coordinate well with her other clothing and accessories. Thus, there is a need for a new bridal headdress that overcomes the deficiencies of earlier designs.

The present invention provides a novel bridal headdress apparatus with features and advantages not found in previous designs. The bridal headdress of the invention includes novel features that are readily observable even from across a room. On the other hand, the headdress of the invention does not detract from other features of the bride's costume. In fact, the bridal headdress not only coordinates well with the other parts of the costume, but also enhances the artistic design of the entire ensemble.

The bridal headdress apparatus of the present invention is simple in design and can be produced relatively inexpensively. Readily available materials and components can be used in its fabrication. Conventional manufacturing techniques and procedures as well as semi-skilled labor can be utilized.

Brides can wear the headdress apparatus of the invention without concern or attention to the article. It can be placed on the head easily and quickly by the wearer without assistance from others. A bride can change the appearance of the headdress simply and easily while wearing it. The design of the bridal headdress can be modified to provide a variety of unique effects conveniently.

These and other benefits and advantages of the novel bridal headdress apparatus of the present invention will be apparent from the following description and the accompanying drawings in which:

FIG. 1 is a front view of one form of the bridal headdress apparatus of the invention being worn by a bride;

FIG. 2 is an enlarged side view in section of the bridal headdress apparatus shown in FIG. 1 taken along line 2—2 thereof;

FIG. 3 is an enlarged fragmentary sectional view of the face section of the bridal headdress apparatus as in FIG. 2;

FIG. 4 is an enlarged rear view from below of the bridal headdress apparatus shown in FIGS. 1 and 2; and FIG. 5 is a further enlarged schematic illustration of portions of the bridal headdress apparatus of the invention.

As shown in the drawings, one form of the novel bridal headdress apparatus 11 of the present invention is worn by a woman 12. The headdress 11 is worn on the head 13 of the woman. A veil section 14 extends from the apparatus 11, advantageously from an upper edge 15 thereof remote from the wearer's head.

The bridal headdress apparatus 11 of the invention includes a frame portion 16, a fastening portion 17, a supporting portion 18, an illuminating portion 19, a diffusing portion 20, a power supplying portion 21 and a circuitry portion 22.

The frame portion 16 of the headdress apparatus 11 includes a face section 24. The face section is formed with spaced generally parallel, horizontal elongated upper and lower peripheral sections 25 and 26. The lower section 26 is located adjacent to the wearer's head and the upper section 25 is spaced therefrom. Peripheral end sections 27 and 28 extend between and connect the horizontal peripheral sections 25 and 26. Advantageously, the horizontal and end sections of the frame portion include covered wire members. The frame portion preferably has a generally arcuate configuration.

The fastening portion 17 of the headdress 11 of the invention includes at least one securing member 29 that extends from the lower horizontal section 26. The securing member may be a comb member 30, a clip member 31 or the like as shown.

The supporting portion 18 of the bridal headdress apparatus 11 extends between the upper and lower horizontal sections 25 and 26. The supporting portion includes an intermediate section 33 such as one or more wire members 34 or more advantageously a membrane section 35 alone, or in combination with the wire members. Preferably, the membrane section includes a mesh fabric such as a horsehair fabric.

The illuminating portion 19 of the headdress 11 includes a plurality of spaced miniature incandescent lamps 36. The lamps 36 are spaced from each other and affixed along the length of the supporting portion 18. The lamps are retained in proper alignment by affixing the same to the supporting portion such as with an adhesive 37.

The lamps 36 preferably have an elongated tubular configuration. Advantageously, the lamps include clear glass or plastic envelopes 38 and preferably are six volt lamps.

The diffusing portion 20 of the bridal headdress apparatus 11 of the invention includes a semi-transparent membrane 39 over the lamps 36. The membrane 39 is disposed on the side of the lamps adjacent the face section 24 of the frame portion, In other words, the lamps are behind the diffusing portion on the head of the wearer.

The diffusing portion advantageously includes a mesh fabric such as an illusion fabric of the type utilized in the veil. The diffusing portion also may include decorative features 40 such as lace and/or representations of flowers, leaves and other suitable designs. These designs may be placed on the diffusing portion in positions which conceal the circuitry and other utilitarian portions of the apparatus. If desired, the diffusing portion may function also as the supporting portion of the apparatus.

The power supplying portion 21 of the headdress apparatus 11 of the invention includes a plurality of thin elongated batteries 41. Advantageously, the batteries may be AAA type 1.5 volt batteries.

The batteries are mounted remote from the face section 24 of the frame portion 16. This can be accomplished by positioning the batteries on a band section 42 that joins the free ends of end sections 27 and 28 of the frame portion. The band section 42 may be narrower than the face section or may be of substantially the same height as the frame portion to provide a continuous circular configuration around the head.

Advantageously, the batteries 41 are retained in a holder member 43 and preferably in a number of holder members, each of which holds a pair of batteries. To facilitate retention of the batteries within the holder members, fastening means such as covers or more advantageously elastic bands 44 may be utilized.

The circuitry portion 22 of the headdress apparatus 11 of the present invention includes primary lead wires or conductors 46 and 47 that connect electrically the power supplying portion 21 with the spaced lamps 36 in parallel. The lamps may be disposed between and affixed to the primary conductors 46 and 47 with secondary conductor wires 48 and 49 such as by soldering. Switch means 50 preferably is included in the circuitry portion and advantageously is disposed adjacent the batteries and holder member.

In the fabrication of the bridal headdress apparatus 11 of the present invention, a prefabricated headpiece in the shape of a tiara or other configuration may be purchsed or alternatively may be custom assembled. The latter may be accomplished by bending a wire member in a continuous generally rectangular arcuate configuration with horizontal sections 25 and 26 and end sections 27 and 28. To stiffen the frame portion, intermediate lengths of wire 34 are connected between the elongated upper and lower sections 25 and 26 at intervals along their lengths.

After the frame portion 16 has been formed, the diffusing portion 20 is secured over the frame portion to form the face section 24 of the headdress apparatus 11 by stitching a mesh fabric membrane 39 to the periphery of the frame portion. Decorations 40 then may be affixed to desired points on the fabric.

Thereafter, primary conductor 46 is fastened along the upper horizontal section 25 and the other primary conductor 47 is secured adjacent to the conductor 46 and spaced therefrom a distance to provide sufficient space for the lamps 36.

The lamps 36 are secured in place between the conductors 46 and 47 with an adhesive. The secondary conductors 48 and 49 from each lamp are soldered to the respective conductors 46 and 47. The lamps are positioned behind the diffusing position 20 so they are visible through the diffusing fabric and are not concealed by the decorations 40. The fabric supporting portion then is affixed to the back of the frame portion with an adhesive to seal the entire assembly together into a unitary structure.

The free extensions of the primary conductors 46 and 47 are formed into a band section 42 that extends between the end sections 27 and 28 of the frame portion to form a continuous generally circular configuration. Battery holder members 43 are positioned along the band section and connected electrically to the conductors 46 and 47. Also, switch 50 is incorporated into the circuitry adjacent one of the holder members.

An elastic band 44 is fastened over the open side of each holder member and pairs of batteries 41 slid into place in the holders to complete the electrical circuitry. A veil section 14 is attached to the upper horizontal section 25 and a comb member 30 is affixed to the lower section 26. The headdress apparatus 11 now is ready for use.

To wear the headdress, a bride 12 simply grasps the end sections 27 and 28 of the apparatus 11 and places the headdress on her head 13 in the desired position as shown in FIGS. 1 and 2 of the drawings. The headdress is slid back slightly along the hair so the comb member 30 engages the hair to hold the headdress securely to the head.

A bride then can proceed with her normal activities associated with the wedding ceremony without concern or attention to the headdress. At appropriate times in the ceremony and/or reception, she can illuminate the lamps by reaching a hand under the veil and actuating the switch 50.

When the lamps are lighted, the headdress will provide a spectacular aesthetically pleasing effect that enhances the beauty of the brides's entire costume and draws attention to the bride's face. These effects are achieved in a subtle fashion without detracting from the overall loveliness of the wedding and its participants. The headdress will be a special feature of the wedding that will be long remembered both by the guests and the wedding party.

The above description and the accompanying drawings show that the present invention provides a novel bridal headdress apparatus with features and advantages not found in previous designs. The bridal headdress of the invention includes novel design features that are readily discernible by the guests at a wedding, even those at considerable distances such as across a room. Thus, the headdress design is apparent to all of the guests simultaneously and not just those who are nearby the bride.

The bridal headdress apparatus of the present invention is simple in design and is relatively inexpensive. The headdress can be produced from readily available materials and components. Conventional manufacturing procedures can be utilized by semi-skilled labor to fabricate the apparatus. The apparatus can be adapted to various headdress designs easily and conveniently.

The headdress is durable in construction and electrically safe. It can be used without attention or concern on the part of the user. The apparatus can be activated or deactivated easily and quickly without assistance while being worn.

It will be apparent that various modifications can be made in the particular bridal headdress apparatus described in detail and shown in the drawings within the scope of the present invention. The size and arrangement of components can be different. Also, the configuration can be changed to meet specific desires or requirements. In addition, the frame portion can include any of a variety of different materials and designs commonly employed in conventional bridal headresses. Furthermore, the headdress may be adapted for other members of the wedding party and for other occasions if desired. These and other changes can be made in the bridal headdress apparatus provided the functioning and operation thereof are not adversely affected. Therefore, the scope of the present invention is to be limited only by the following claims.

What is claimed is:

1. Bridal headdress apparatus including a frame portion, a fastening portion, a supporting portion, an illuminating portion, a power supplying portion and a circuitry portion; said frame portion including a face section formed with spaced generally parallel horizontal elongated upper and lower peripheral sections, end sections extending between said horizontal sections; said fastening portion including at least one securing member extending from said lower horizontal section; said supporting portion including an intermediate section extending between said horizontal upper and lower peripheral sections; said illuminating portion including a plurality of spaced miniature incandescent lamps disposed along the length of said supporting portion; said power supplying portion including a plurality of thin elongated batteries, said batteries being mounted remote from said lamps; said circuitry portion including conductive means connecting said spaced lamps in parallel electrically with said batteries and switch means controlling the flow of electrical current from said batteries to said lamps.

2. Bridal headdress apparatus according to claim 1 wherein said peripheral horizontal and end sections of said frame portion include wire members.

3. Bridal headdress apparatus according to claim 1 wherein said frame portion has a generally arcuate configuration.

4. Bridal headdress apparatus according to claim 1 wherein a veil section extends from said frame portion.

5. Bridal headdress apparatus according to claim 4 wherein said veil section extends from said upper horizontal section of said frame portion.

6. Bridal headdress apparatus according to claim 1 wherein said fastening portion includes a comb member.

7. Bridal headdress apparatus according to claim 1 wherein said fastening portion includes a clip member.

8. Bridal headdress apparatus according to claim 1 wherein said intermediate section of said supporting portion includes a membrane section.

9. Bridal headdress apparatus according to claim 1 wherein said miniature lamps of said illuminating portion have an elongated tubular configuration.

10. Bridal headdress apparatus according to claim 1 wherein said lamps are secured to said circuitry portion by soldering.

11. Bridal headdress apparatus according to claim 1 including a band section joining free ends of said frame portion.

12. Bridal headdress apparatus according to claim 1 wherein said batteries are disposed on said band section.

13. Bridal headdress apparatus according to claim 1 wherein said batteries are retained in a holder member.

14. Bridal headdress apparatus according to claim 13 wherein pairs of batteries are retained in adjoining holder members.

15. Bridal headdress apparatus according to claim 13 wherein said batteries are held in said holder member with an elastic band.

16. Bridal headdress apparatus according to claim 1 wherein said switch means of said circuitry portion is disposed adjacent said batteries.

17. Bridal headdress apparatus according to claim 1 wherein said circuitry portion is affixed to said supporting portion with an adhesive.

18. Bridal headdress apparatus according to claim 1 including a diffusing portion, said diffusing portion including a semi-transparent membrane over said lamps, said membrane being disposed on the side of said lamps that is not in contact with said supporting portion.

19. Bridal headdress apparatus according to claim 18 wherein said semi-transparent membrane of said diffusing portion includes a mesh fabric.

20. Bridal headdress apparatus according to claim 18 wherein said diffusing portion includes decorative features.

* * * * *